United States Patent [19]

Hirano et al.

[11] 4,451,942

[45] Jun. 5, 1984

[54] LOCAL WASHING DEVICE OF FLUSH TOILET

[75] Inventors: Yoshio Hirano; Noriyuki Tokunaga; Hidekazu Murabayashi; Takumi Urayama, all of Kadoma, Japan

[73] Assignee: Matsushita Electric Works, Ltd., Osaka, Japan

[21] Appl. No.: 418,457

[22] Filed: Sep. 15, 1982

[51] Int. Cl.[3] ..... A47K 4/00; A47K 3/02

[52] U.S. Cl. ..... 4/420.2; 4/420.4; 4/443; 4/448

[58] Field of Search ..... 4/443, 447, 448, 420.1–420.3

[56] References Cited

U.S. PATENT DOCUMENTS

| | | | |
|---|---|---|---|
| 1,866,930 | 7/1932 | Guidetti | 4/420.2 |
| 2,094,170 | 9/1937 | Heald | 4/420.2 |
| 3,570,015 | 3/1971 | Rosengaus | 4/420.4 |
| 3,605,124 | 9/1971 | Marcard et al. | 4/420.2 |
| 4,041,553 | 8/1977 | Sussman | 4/447 |
| 4,068,325 | 1/1978 | Benthin | 4/420.4 |
| 4,094,018 | 6/1978 | Bemthin | 4/420.4 |
| 4,242,764 | 1/1981 | Fukuda | 4/420.4 |
| 4,304,016 | 12/1981 | Oguma et al. | 4/420.2 |
| 4,340,980 | 7/1982 | Fushimi et al. | 4/420.2 X |
| 4,391,004 | 7/1983 | Kawa et al. | 4/420.4 X |

*Primary Examiner*—Henry K. Artis

*Attorney, Agent, or Firm*—Burns, Doane, Swecker & Mathis

[57] ABSTRACT

A local washing device of flush toilet for cleaning the user's body part with heated water ejected toward the part under varying pressures preventing drastic initial ejection. The device comprises a heated water tank supplied with water from a flushing water reservoir, a nozzle arm connected at an end to the tank and rotatable between extruded and retreated positions at the other free end forming water ejecting nozzle, and means for controlling water-ejecting pressure to be initially low and gradually high enough for achieving desired washing.

6 Claims, 11 Drawing Figures

LOCAL WASHING DEVICE OF FLUSH TOILET

BACKGROUND OF THE INVENTION

This invention relates generally to a local washing device for use with a flush toilet capable of washing the user's anus or the like body part and, more particularly, to a device used in association with the flush toilet for cleaning such a body part as anus with a heated water ejected from a nozzle under varying pressures.

The local washing device associated with the flush toilet of the kind referred to is arranged so that, when a lever attached to the toilet is operated, the nozzle connected to a heated-water source can be rotated to be positioned, for example, directly below the user's anus and pressurized heated-water is ejected from the nozzle toward the anus to clean it. With the known arrangement, however, there have been such problems that a flow control valve disposed in a pipe between the heated-water source and the nozzle must carefully controlled and, otherwise, cold water remained between the valve and nozzle after the previous use may hit upon the anus to give an uncomfortable feeling to the user or, on the contrary, the user may receive a sudden ejection of water excessively heated and having already reached the nozzle to even get scalded.

SUMMARY OF THE INVENTION

Accordingly, it is a primary object of the present invention to provide a local washing device of flush toilet wherein, even if a heated-water supply means is in a state of ejecting water in its full extent, a slow initiation of ejection can be always achieved.

Another object of the present invention is to provide a local washing device of flush toilet wherein the initial pressure of water ejected from the nozzle can be made low at the initial stage of each ejection and subsequently increased gradually up to a desired level.

A further object of the present invention is to provide a local washing device of flush toilet wherein an arrangement is provided for enabling it possible to clean water-ejecting nozzle itself of the device when the nozzle is retreated to a position of preventing it from being stained at the next use of the toilet;

Still another object of the present invention is to provide a local washing device of flush toilet wherein heated-water can be ejected out of a nozzle only when the nozzle is at an extruded position of performing the local washing and at a retreated position of achieving a self-cleaning.

BRIEF DESCRIPTION OF THE DRAWINGS

Other objects and advantages of the present invention shall be made clear in the following descriptions of the invention detailed with reference to a preferred embodiment shown in accompanying drawings, in which.

DESCRIPTION OF THE PREFERRED EMBODIMENT

While the present invention shall now be described with reference to the preferred embodiment shown in the accompanying drawings, the intention is not to limit the invention only to the particular embodiment but rather to include all modifications, alterations and equivalent arrangements possible within the scope of appended claims.

Figure 1:
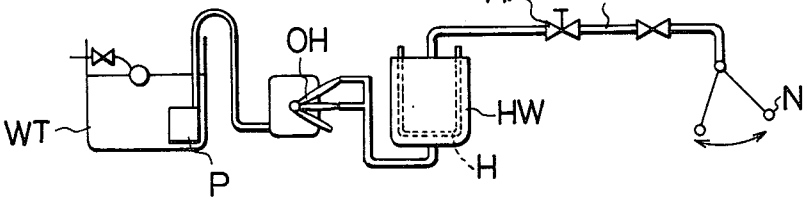
Fig. 1 (PRIOR ART)
FIG. 1 is a schematic explanatory view of a general local washing device.
Figure 5:
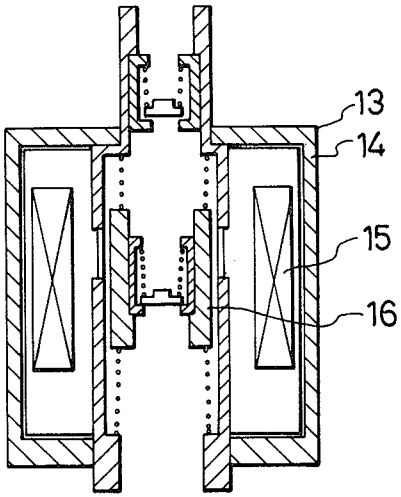
FIG. 5 is a fragmentary section as magnified of an electromagnetic valve means in the device of FIG. 2 to be disposed in a flush water reservoir of the toilet.

Prior to descriptions of the invention, a generally known local washing device of flush toilets shall be first explained briefly with reference to FIG. 1, wherein a pump P placed in a flush water tank WT is driven by an operating handle OH so as to supply water from the tank to a heated-water tank HW containing a heater H. By actuating a flow adjusting valve AF, heated-water at the tank HW can be ejected out of a nozzle N through a water feed pipe FP and, by positioning the nozzle N to oppose the user's body part to be washed, he can be locally washed and cleaned. With this arrangement, however, no proper flow control means other than the valve AF is provided in the path from the pump P to the feed pipe FP so that, if the valve AF is fully opened carelessly quickly, heated-water under a high pressure will be ejected from the nozzle N and an uncomfortable feeling will have to be given to the user. The present invention has been suggested to eliminate such defect of the known device.

Referring to FIGS. 2 to 7, there is shown a local washing device of the flush toilet, which comprises a heated-water supplying mechanism 10 having a water sucking electromagnetic pump 13 to be disposed in a reservoir 12 for supplying water to a toilet bowl 11 for its flushing purpose. The pump 13 has a solenoid 15 housed in a casing 14 and this solenoid 15 is excited by a pump driving circuit in a control circuit which will be described later to allow a valve plunger 16 to be displaced as seen best in FIG. 5, whereby the pump 13 is made to be in its open state and a water feed to a heated-water tank 18 through a linkage pipe 17 is made possible. The tank 18 comprises a lower casing 19 of such heat conductive material as copper and an upper casing 20 of such heat insulating material as polypropylene, which are coupled integral by means of a packing 21. The lower casing 19 is provided with a heater 22 disposed therein and an inlet port 23 connected to the linkage pipe 17. In the vicinity of the inlet port 23, a first heat-sensitive element 24 such as a thermistor is provided to the lower casing, while the upper casing 20 is provided at its upper portion with an outlet 25 and a second heat-sensitive element 26 also such as a thermistor which projects into the casing 20, and the first and second heat-sensitive elements 24 and 26 form a part of the control circuit.

The heated-water tank 18 is covered by a tank housing 27 having on the upper face control dials or buttons 28 as will be detailed later. The housing 27 is further provided with an operating lever 29 pivotably fitted to an upper side face. As will be seen, in particular in FIG. 6, the lever 29 is connected to a coupler 30 axially rotatably fitted to an upper portion of the upper casing 20. A hollow nozzle arm 31 is connected at its straight base end to the coupler 30 by means of a screw 32 so as to be axially rotated in cooperation with the lever 29. Further, a water feed sleeve 33 is provided in the upper casing 20 to be continuous to the coupler 30 liquid-tightly while enclosing therein the straight base end portion of the nozzle arm 31 allowing the axial rotation. In this base end portion of the arm 31 within the sleeve, a slit 34 extending in the axial direction of the arm is provided. In the sleeve 33, holes 35 and 36 are provided with which the slit 34 of the nozzle arm 31 is aligned when the arm is rotated to the respective extruded (extended) and retreated (retracted) positions (FIG. 7). The water feed sleeve 33 communicates with the outlet port 25 of the upper casing 20 through a needle valve 37 for regulating the pressure of water flowing therethrough to the sleeve as controlled by rotating an adjustment knob 38.

Figure 3:
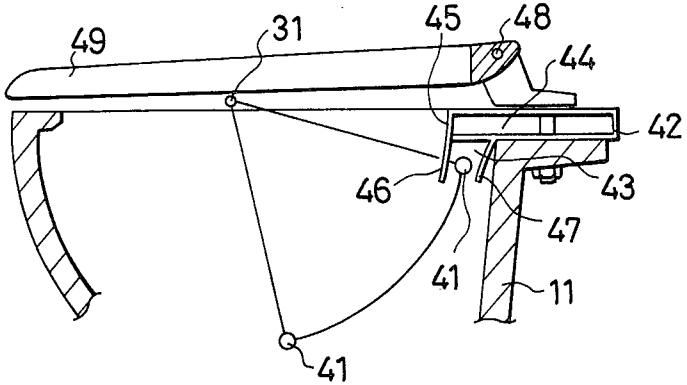
FIG. 3 is a fragmentary section of the toilet for showing schematically an arrangement for cleaning water-ejecting nozzle and blowing hot-air thereto in the device of FIG. 2.
Figure 2:
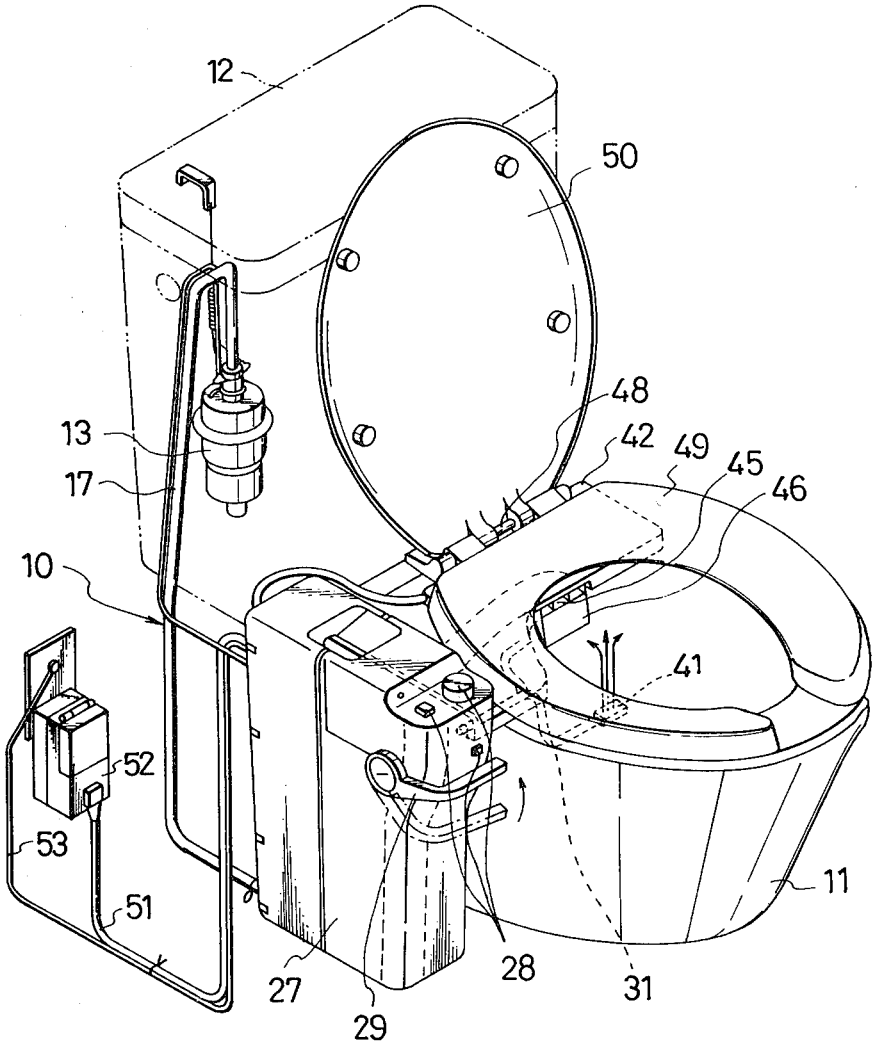
FIG. 2 is a perspective view of a local washing device according to the present invention shown in association with a flush toilet.
Figure 4:
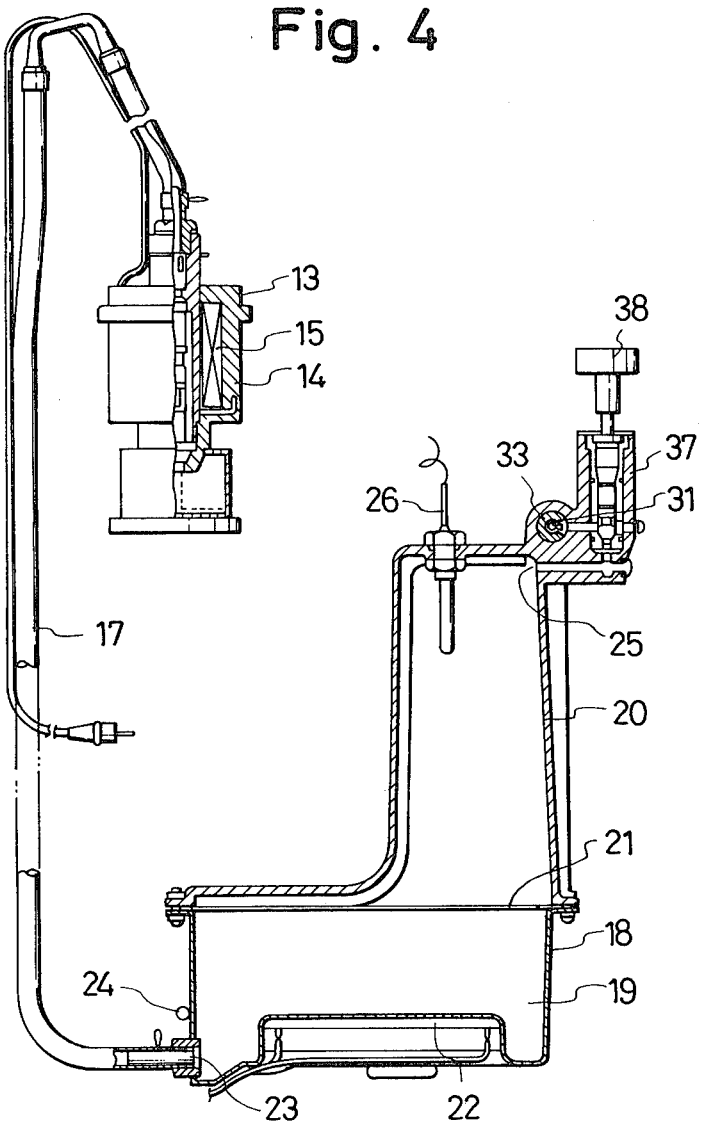
FIG. 4 is a fragmentary side elevation for schematically showing partially in section a heated-water source and its associated arrangement in the device of FIG. 2.
Figure 6:
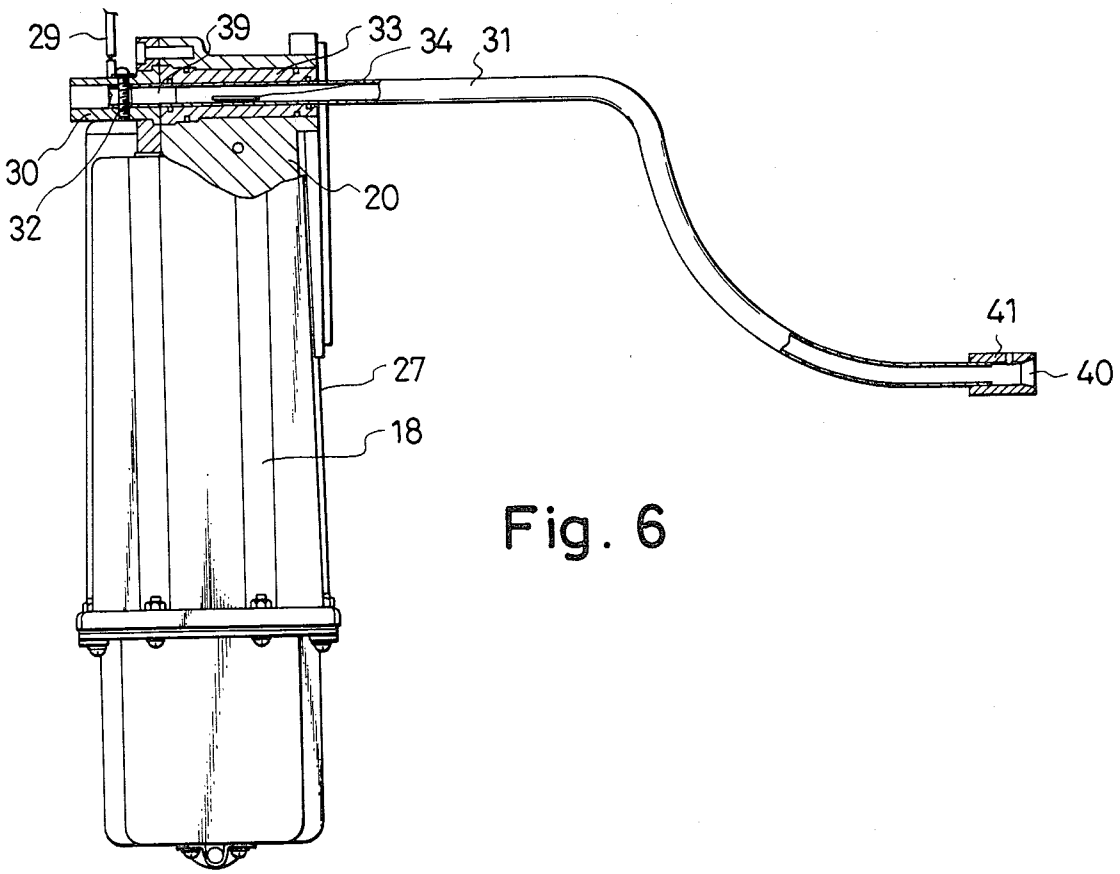
FIG. 6 is a front elevation of the heated-water source partially in section for showing an interconnecting arrangement between the source and a water supply pipe in the device of FIG. 2.
Figure 7:
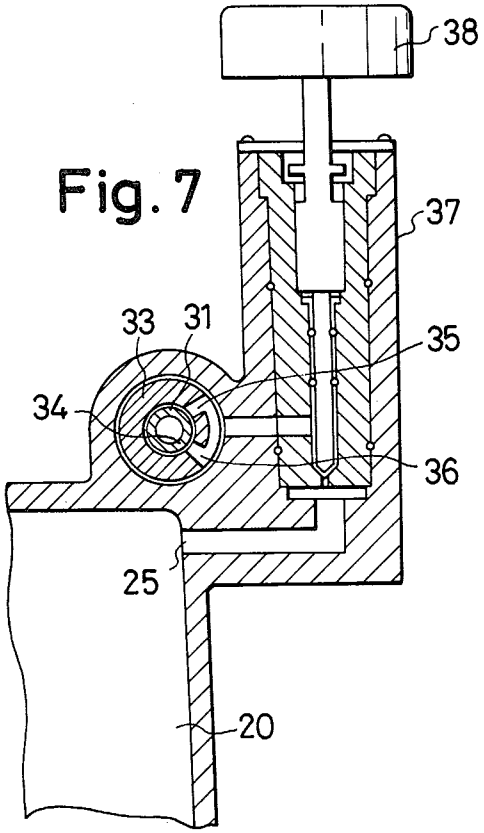
FIG. 7 is a fragmentary section as magnified of the interconnecting arrangement of FIG. 6, taken on a plane vertical to the section of FIG. 6.

As shown in FIG. 6, a plug 39 is sealingly inserted into the straight base end of the nozzle arm 31 and another plug 40 is sealingly fitted to an open end of a nozzle 41 secured to the other free end of the arm 31 which is bent into an arcuate shape so that the free end of the arm 31 can be rotated about 90 degrees between the extruded position substantially in the lower mid portion inside the toilet bowl 11 and the retreated position near the back portion inside the bowl 11, in the latter position of which the nozzle 41 is located in a nozzle washing chamber 43 defined by a bowl mounting frame 42 through which the bowl 11 and tank housing 27 are interconnected (FIG. 3).

The mounting frame 42 defines therein a hot-air duct 44 into which hot air is sent from the tank housing 27 by means of any known blower mechanism (not shown in the drawings), and this duct 44 communicates with an opening 45 of the frame 42 made immediately above the nozzle washing chamber 43 so that the hot air can be blown to the upper zone inside the bowl 11. The nozzle washing chamber 43 is defined by reflecting plates 46 and 47 downward extended from the frame 42 as slightly inclined inward the bowl 11, whereby the ejected water from the nozzle 41 retracted into the chamber 43 will be reflected back by the lower surface of the frame 42 and reflecting plates 46 and 47 toward the nozzle 41 to effectively wash and clean the same. Further, on the back side of the bowl 11, a bowl seat 49 and cover 50 are secured to the mounting frame 42 rotatably about a pivot shaft 48, to be positioned above the frame 42.

The tank housing 27 houses therein the control circuit as disposed in, for example, a heat insulating chamber provided in the upper portion of the housing 27, and power feeding lines 51 to the control circuit are connected through a circuit breaker 52 to an A.C. power source while a grounding cable 53 is properly provided. Further, a microswitch (not shown) forming a part of the control circuit is mounted on the tank housing 27 so that the electromagnetic pump 13 can be driven in response to a rotation of the operating lever 29.

Figure 8:
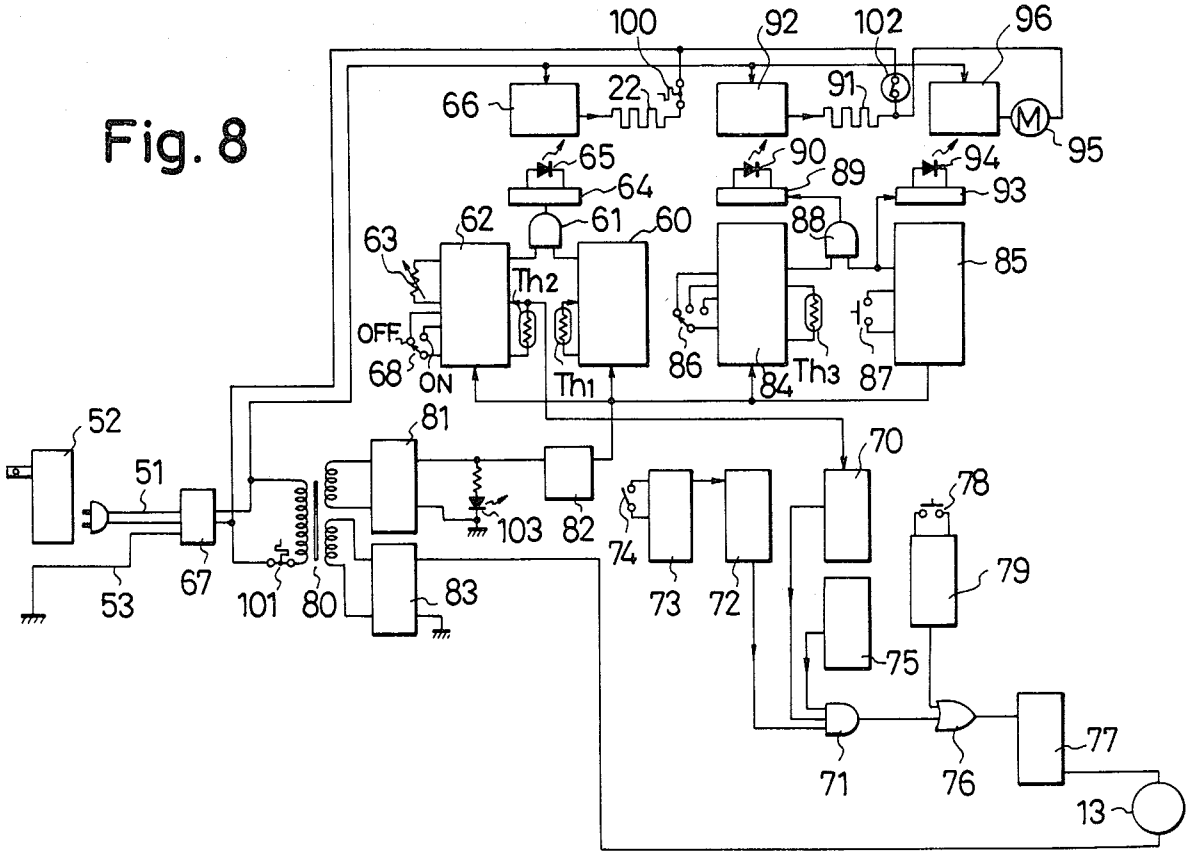
FIG. 8 is a block diagram of a control circuit for the device of FIG. 2.
Figure 9A:
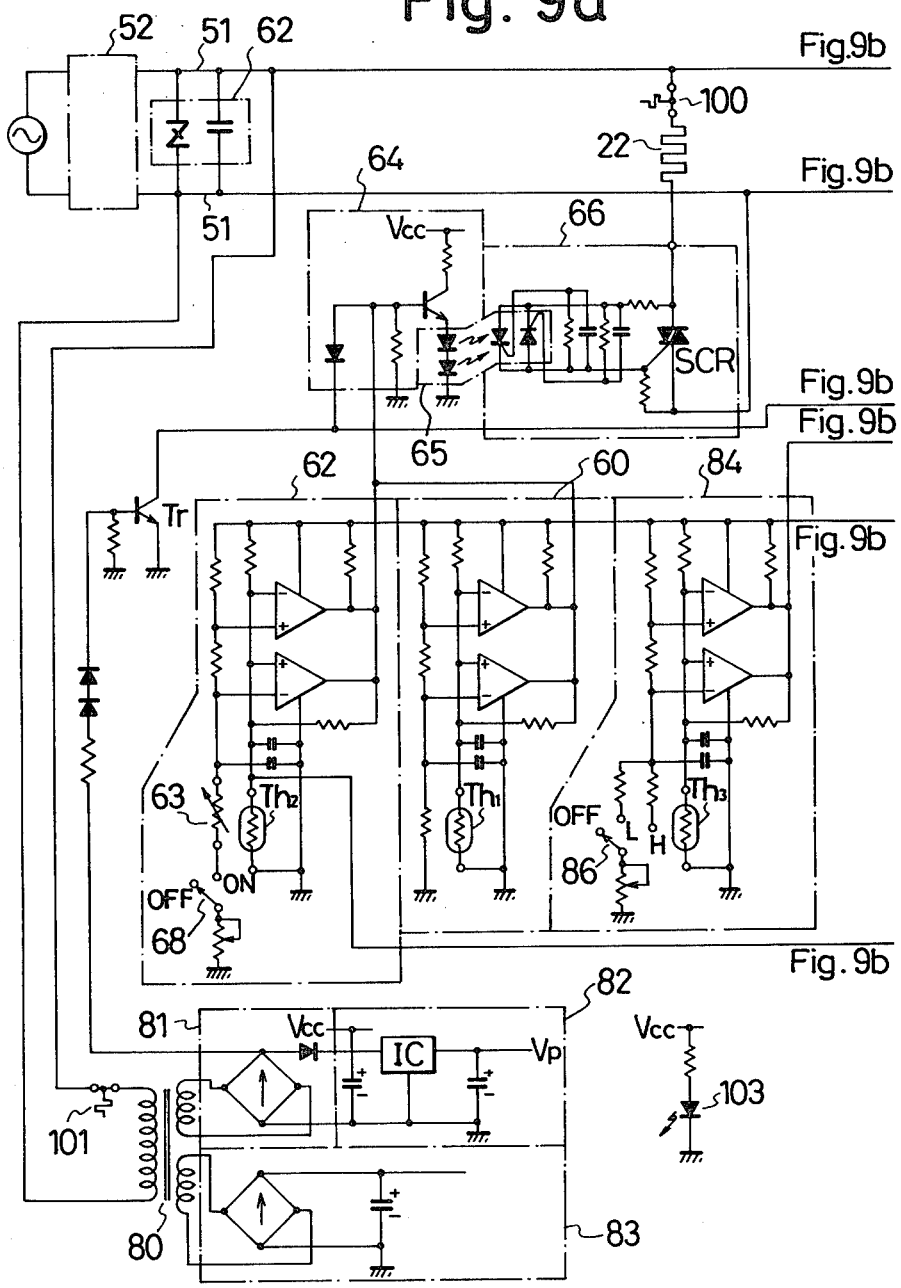
FIGS. 9*a* and 9*b* show jointly a practical circuit arrangement of the control circuit of FIG. 8.
Figure 9B:
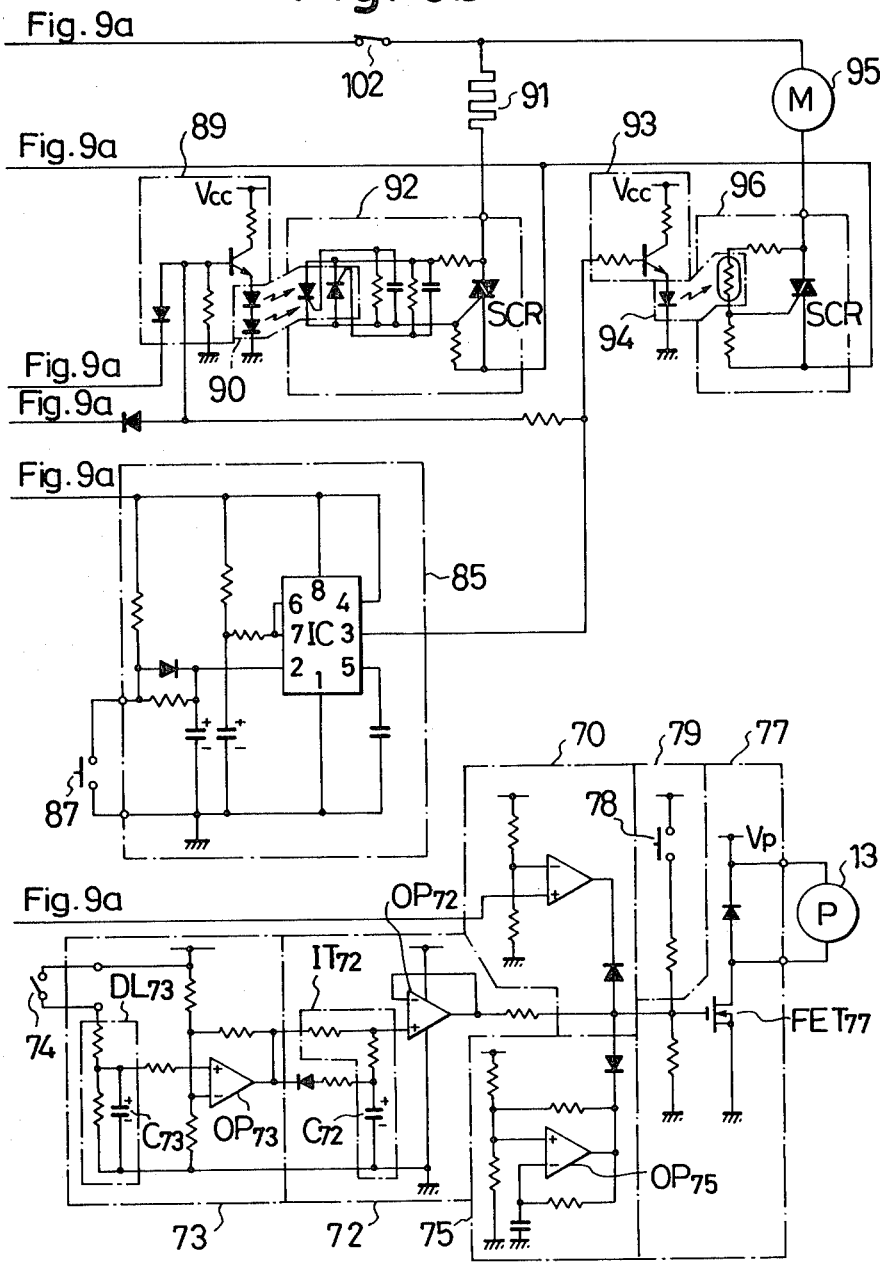

Referring now to the control circuit with reference to FIGS. 8 and 9*a* and 9*b*, respective blocks in FIG. 8 being identified in FIGS. 9*a* and 9*b* as encircled by chain lines and given the same numbers, a thermistor $Th_1$ used as the first heat-sensitive element 24 mounted to the lower casing 19 of the heated-water tank 18 as explained before is connected to a temperature control circuit 60 for the tank 18. This control circuit 60 is designed so as to vary its output signal level at a predetermined temperature of, for example, 110° F., and is connected at its output terminal to one input terminal of an AND gate 61. On the other hand, a thermistor $Th_2$ used as the second heat-sensitive element 26 is connected to a heated-water temperature control circuit 62 which is designed to be capable of varying its output signal level in response to a predetermined temperature for the heated-water in the upper casing 20 in a range of, for example, 77° to 110° F., by varying a set level of a variable resistor 63, and is connected at its output terminal to the other input terminal of the AND gate 61. When neither one of these predetermined temperatures is detected by the respective thermistors $Th_1$ and $Th_2$, the output signals of the temperature control circuits 60 and 62 are both at high level, whereby the AND gate 61 is made to provide an output to drive a driver circuit 64 and a photodiode 65 is made to be ON, upon which such semiconductor connected photoelectrically to the photodiode as a photoconductive thyristor provided in a switching circuit 66 connected in series with the heater 22 is turned ON to maintain the switching circuit 66 in its ON state, and a source power is supplied to the heater 22 from the A.C. power source through the breaker 52, feeding lines 51 connected to a line filter 67, and circuit 66, so that water in the tank 18 will be heated to a desired temperature.

When, on the other hand, either one of the thermistors $Th_1$ and $Th_2$ detects a temperature higher than the predetermined level, either one of the output signals of the control circuits 60 and 62 will be at low level, so that the driver circuit 64 is not activated and the photodiode 65 is turned OFF, whereby the switching circuit 66 is turned off to stop the power supply to the heater 22. Preferably, the heated-water-temperature control circuit 62 is provided with a manual switch 68 so that, when this switch is placed in its OFF position as shown in FIG. 8, the output of the circuit 62 will be at low level and no power will be supplied to the heater 22, and water of a normal temperature is ejected from the nozzle 41. Further, in an event when the power is supplied to the heater 22 in a state no water is contained in the tank 18, then the output of the control circuit 60 connected to the thermistor $Th_1$ on the lower casing 19 will become low level to supply no power to the heater 22, so that any heating without water in the tank can be prevented from occurring.

The thermistor $Th_2$ forming the second heat-sensitive element 26 is also connected to a heated-water-temperature detecting circuit 70, output signal level of which is changed when the thermistor $Th_2$ detects such excessive temperature as, for example, 122° F. The output of the circuit 70 is provided to one of three input terminals of an AND gate 71 which is connected at the other input terminals to a slow-start circuit 72 and an oscillator circuit 75. The slow-start circuit 72 is connected to a timer circuit 73 which in turn is connected to a microswitch 74 closed when the operating lever 29 is rotated, as explained before, from the retreated position to the extruded position of the nozzle. Upon this rotation of the lever 29 and the closing of the microswitch 74, a charging voltage across a capacitor $C_{72}$ of an integration circuit $IT_{72}$ in the slow-start circuit 72 will increase, whereby an output of a D.C. operational amplifier $OP_{72}$ also in the circuit 72 is gradually increased and is applied to one of the other input terminals of the AND gate 71. The oscillator circuit 75 connected to the remaining input terminal of the AND gate 71 is for driving the electromagnetic pump 13, and an oscillation output from an operational amplifier $OP_{75}$ of the oscillation circuit 75 controls the solenoid 15 of the pump 13. Accordingly, the AND gate 71 receives high level signals at all of the input terminals so long as the temperature detected by the thermistor $Th_2$ is below the predetermined level, the microswitch 74 is closed and the oscillation circuit 75 is in the oscillating state, whereby a pump driving circuit 77 is driven through an OR gate 76. In this case, more specifically, the current fed to the pump 13 is caused to be gradually increased by a field-effect transistor $FET_{77}$ in the circuit 77 so as to gradually open an electromagnetic valve of the pump 13, whereby water is supplied from the water reservoir 12 to the heated-water tank 18 and further to the nozzle arm 31 initially under a low pressure.

During the ON state of the microswitch 74 with the operating lever 29 rotated, on the other hand, a capacitor $C_{73}$ in a delay circuit $DL_{73}$ of the timer circuit 73 is also being charged so that, when the lever 29 is returned to the retreated position of the nozzle and the microswitch 74 is turned OFF, the capacitor $C_{73}$ will be discharged to provide a high level output from the slow-start circuit 72 again to the AND gate 71 through an operational amplifier $OP_{73}$, whereby the pump 13 is actuated and water is supplied for a predetermined period of time. If the thermistor $Th_2$ forming the second heat-sensitive element 26 and connected to the heated-water-temperature detector 70 is subjected to a temperature, for example, above 122° F., then the pump driving circuit 77 will not be operated and an excessively hot water ejection from the nozzle 41 can be prevented, since the outputs of the detecting circuit 70 as well as the AND gate 71 are at low level.

The other input terminal of the OR gate 76 is connected with an output terminal of a washing circuit 79 which is operated by a manual actuation of a pushbutton 78 mounted on the tank housing 27 so that, even when the AND gate 71 provides no high level output signal, the washing circuit 79 will operate the pump driving circuit 77 and water can be ejected from the nozzle by the manual pushbotton actuation.

In addition, a rectified voltage is applied to the temperature control circuits 60 and 62 and their associated networks through a rectifying circuit 81 and voltage stabilizing circuit 82 connected to a secondary winding of a transformer 80 which is connected on the primary winding side to the power feeding lines 51 and line filter 67, while another rectified voltage is applied to the electromagnetic pump 13 through another rectifying circuit 83. To the rectifying circuit 81 and voltage stabilizing circuit 82, further, a hot-air control circuit 84 and hot-air-fan timer circuit 85 are connected. The circuit 84 is provided with a change-over switch 86 so as to provide a high level output to an AND gate 88, in cooperation with such a heat-sensitive element as a thermistor $Th_3$ disposed in the hot-air duct 44, unitl the hot-air reaches a temperature set by the switch 86. On the other hand, the timer 85 started by actuating a pushbutton 87 provides a high level output to the other input terminal of the AND gate 88 for a predetermined duration of, for example, 90 seconds, to render the AND gate 88 and its associated driving circuit 89 to be activated and a photodiode 90 is thereby turned ON. This causes a photoconductive semiconductor provided in a switching circuit 92 connected in series with an air heater 91 and photoelectrically connected to the diode 90 to be turned ON, and a current is supplied to the heater 91 from the A.C. power source through the feeding lines 51 to heat the heater 91. At the same time, another driving circuit 93 is driven by the timer circuit 85 so that a photodiode 94 connected to this circuit 93 is photoelectrically connected to a photoconductive semiconductor element in a switching circuit 96, whereby the A.C. source current is supplied to a hot-air motor 95 connected to the circuit 96 and a hot air of a proper temperature is blown out of the opening 45 of the hot-air duct 44.

In the foregoing control circuit, preferably, a fuse 100 for the heater 22 of the heated-water tank 18 and another fuse 101 on the primary winding side of the transformer 80, and a bimetal 102 for the air heater 90 are provided. Further, the rectifying circuit 81 is preferably provided with a photodiode 103 on the tank housing 27 in order to indicate the ON state of the device.

The operation of the local washing device of flush toilet according to the present invention shall be further explained briefly. Now, the user rotates the operating lever 29 of the tank housing 27 after his use of the toilet, then the nozzle 41 mounted on the free end of the nozzle arm 31 is shifted from the retreated position inside the nozzle washing chamber 43 to the extended position substantially directly below the user's anus, causing the microswitch 74 to be turned ON. When the variable resistor 63 connected to the heated-water-temperature control circuit 62 is adjusted in respect of the volume and the manual switch 68 is switched ON, then the outputs of the both control circuit 60 and 62 will cause the switching circuit 66 to be turned ON so long as the thermistors $Th_1$ and $Th_2$ forming the first and second heat-sensitive elements 24 and 26 do not detect abnormal temperature. As a result, water heated to a proper temperature is produced in the tank 18 by the heater 100. At the same time, so long as the heated-water-temperature detecting circuit 70 connected to the thermistor $Th_2$ of the second heat-sensitive element 26 does not detect any abnormal temperature, the circuit 70 will provide a high level output to the AND gate 71 which also receiving at the other input terminals the gradually increasing output from the slow-start circuit 72 and the oscillation output from the oscillation circuit 75, and the current supplied through the OR gate 76 and pump driving circuit 77 to the solenoid 15 of the pump 13 is gradually increased in the level so as to gradually open the electromagnetic valve of the pump.

Figure 10:
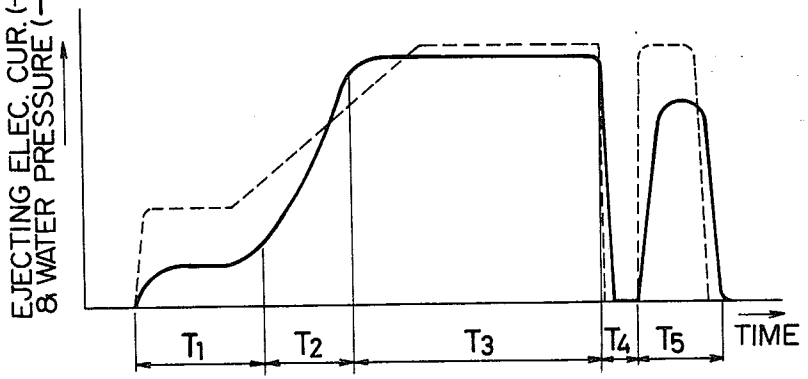
FIG. 10 is a diagram showing water-ejection characteristics of the device according to the present invention.

When on the other hand, the nozzle arm 31 is at the extruded washing position, the heated water can be ejected out of the nozzle 41 according to the supplied amount of water from the reservoir 12 that is gradually increased since the slit 34 in the base portion of the nozzle arm 31 is aligned with the first hole 35 of the water feed sleeve 33 communicating with the inlet port 25 of the heated-water tank 18 through the needle valve 37. When the nozzle arm 31 is shifted to the retreated position, too, the slit 34 is aligned with the second hole 36 in the sleeve 33, the timer circuit 85 again actuates the pump 13 to have water ejected out of the nozzle 41. More specifically, such a current as shown, for example, by a dotted line in FIG. 10 is caused to flow to the solenoid 15 of the pump 13 through, in particular, the timer circuit 85, slow-start circuit 72 and pump driving circuit 77, whereby water is ejected out of the nozzle 41 under such varying pressures as illustrated by a solid line in FIG. 10. In other words, during a first term $T_1$ (preferably about 3 seconds), the water ejection from the nozzle 41 is effected very slack and any relatively cold water remained in the nozzle arm 31 after the previous use of the device can be fully discharged without reaching the user's body. In the next term $T_2$ (preferably about 2 seconds), the ejecting pressure is gradually increased so that the user receives the locally washing water ejection under gradually increasing pressures starting initially low, and during the further term $T_3$ the water ejection from the nozzle 41 is made under a sufficient pressure for performing the local washing. The duration of this term $T_3$ can be set as desired depending upon the time for which the user continues to rotate the control lever 29. Next, during the term $T_4$ (preferably about 1 second) in which the lever 29 is rotated to position the nozzle arm 31 to the retreated position of the nozzle, the microswitch 74 is turned off and the water ejection is ceased by the output delaying action of the timer circuit 85 and, when the nozzle 41 is positioned subsequently in the nozzle washing chamber 43, the output of the timer circuit 85 is caused to be provided to have water ejected from the nozzle during the last term $T_5$ (preferably about 2 seconds), so that the ejected water hits against the reflecting plates 46 and 47 of the chamber 43 and lower surface of the frame 42, whereby the nozzle 41 itself is washed to be cleaned by such reflected water.

When the pushbutton 87 is depressed with the change-over switch 86 properly set beforehand, then the heater 91 and motor 95 are energized by the output signals of the hot-air controlling circuit 84 and fan timer 85, whereby the hot air is discharged out of the opening 45 of the duct 44 for a term of preferably about 90 seconds and the user's body part washed and wet can be dried optimumly effectively in wintertime, in particular.

Further, it is possible to optionally perform the ejection of water at normal temperature by pushing the pushbutton 78 and operating the washing circuit 79 independently of other circuits, either at the extruded or retreated position of the nozzle 41. In addition, the power supply to the heater 22 in the tank 18 can be automatically stopped upon the excessive rise in the temperature of water in the tank 18 or the tank itself in emptied state, so that the safetiness of the device is improved remarkably.

According to the local washing device of flush toilet of the present invention arranged as has been disclosed, it is possible to prevent that the local washing water hits the user suddenly at a high pressure to let him feel uncomfortable or at an abnormally high temperature to cause him scalded, and that the user is subjected to an ejection of cold water remained inside the nozzle after the previous use, so that the device according to the present invention can achieve such remarkable effects that the user can use the device without any uncomfortable feeling, the nozzle itself can be kept clean at all time, and so on.

What we claim as our invention is:

1. A local washing device of flush toilet comprising a flushing water reservoir supplying water to a toilet bowl, conduit means having an outlet and an inlet communicating with said water reservoir, a heated-water tank communicating with said outlet to receive water from the water reservoir and having means for heating the water supplied, a nozzle arm connected at one end to said heated-water tank and being rotatable so that the other, free end is movable between respective retracted and extended positions inside said bowl, a nozzle provided at said free end of said nozzle arm to be capable of opposing the user's body part to be washed when said nozzle arm is positioned in said extended position, said nozzle arm communicating said nozzle arm with said heated-water tank, an electromagnetic pump disposed in said reservoir and communicating with said inlet of said conduit means, and an electric circuit for supplying to said pump an initially small amount of exciting current for slowly starting a stream of water from said nozzle toward said user's body part at a low pressure, and a subsequently higher amount of exciting current for increasing the pressure of the water stream after an initial amount of water has been ejected at low pressure from said nozzle.

2. A local washing device according to claim 1, wherein said pump includes a solenoid and a valve shiftable electromagnetically in response to the excitations of said solenoid.

3. A device according to claim 1, which further comprises means for communicating said nozzle with said heated-water tank at each of said retracted and extended positions of said nozzle arm.

4. A device according to claim 3, which further comprises a switch made ON by said nozzle arm rotated only into said extended position for making said current supply to said electromagnetic pump, and means for energizing the pump only when the nozzle arm is in said retracted position and said switch is made OFF.

5. A device according to claim 1, which further comprises means provided to enaclose said nozzle when aaid nozzle arm is in said retracted position for reflecting water ejected from the nozzle back to the nozzle for its own cleaning.

6. A device according to claim 1, which further comprises means for selectively supplying to said nozzle water either as heated or at normal temperature.

* * * * *